US010446315B2

(12) United States Patent
Yu et al.

(10) Patent No.: US 10,446,315 B2
(45) Date of Patent: Oct. 15, 2019

(54) INDUCTANCE ELEMENT

(71) Applicant: Wistron Corporation, New Taipei (TW)

(72) Inventors: Chung-Cheng Yu, New Taipei (TW); Pi-Jung Hsieh, New Taipei (TW); Shang-Yuan Huang, New Taipei (TW)

(73) Assignee: WISTRON CORPORATION, New Taipei (TW)

( * ) Notice: Subject to any disclaimer, the term of this patent is extended or adjusted under 35 U.S.C. 154(b) by 95 days.

(21) Appl. No.: 14/955,427

(22) Filed: Dec. 1, 2015

(65) Prior Publication Data

US 2016/0181006 A1 Jun. 23, 2016

(30) Foreign Application Priority Data

Dec. 22, 2014 (TW) ..... 103222678 U

(51) Int. Cl.

| | |
|---|---|
| ***H01F 27/02*** | (2006.01) |
| ***H01F 27/28*** | (2006.01) |
| ***H01F 27/04*** | (2006.01) |
| ***H01F 27/29*** | (2006.01) |
| ***H01F 27/30*** | (2006.01) |

(52) U.S. Cl.

CPC ..... *H01F 27/2828* (2013.01); *H01F 27/04* (2013.01); *H01F 27/292* (2013.01); *H01F 27/306* (2013.01)

(58) Field of Classification Search

CPC ..... H01F 27/2828
USPC ..... 336/221
See application file for complete search history.

(56) References Cited

U.S. PATENT DOCUMENTS

| | | | | |
|---|---|---|---|---|
| 5,805,431 | A * | 9/1998 | Joshi | H01F 27/292 174/535 |
| 7,142,084 | B2 * | 11/2006 | Cheng | H01F 27/292 336/200 |
| 2009/0152003 | A1 * | 6/2009 | Feist | H01F 27/027 174/549 |
| 2009/0256666 | A1 * | 10/2009 | Shieh | H01F 27/027 336/90 |
| 2012/0249276 | A1 * | 10/2012 | Fontana | H01F 17/0013 336/105 |

FOREIGN PATENT DOCUMENTS

| | | |
|---|---|---|
| TW | M308477 | 3/2007 |
| TW | 200935463 A | 8/2009 |
| TW | M452433 | 5/2013 |
| TW | M452533 | 5/2013 |
| TW | M463414 | 10/2013 |

OTHER PUBLICATIONS

Enlgish translation of twain publication 200935463.*

* cited by examiner

*Primary Examiner* — Ronald Hinson
(74) *Attorney, Agent, or Firm* — McClure, Qualey & Rodack, LLP

(57) ABSTRACT

An inductance element includes a housing, a core, and a coil. The core is assembled in the housing. The coil includes a wire and two plate-shaped pins. The wire surrounds the core. The two plate-shaped pins are respectively assembled to two ends of the wire. The thickness of each of the plate-shaped pins is less than the diameter of the wire, and the two plate-shaped pins are exposed from the housing through two grooves of the housing, respectively.

15 Claims, 9 Drawing Sheets

INDUCTANCE ELEMENT

CROSS-REFERENCES TO RELATED APPLICATIONS

This non-provisional application claims priority under 35 U.S.C. § 119(a) on Patent Application No. 103222678 filed in Taiwan, R.O.C. on 2014 Dec. 22, the entire contents of which are hereby incorporated by reference.

BACKGROUND

Technical Field

The instant disclosure relates to a passive component, and particularly relates to an inductance element with simplified structure.

Related Art

To simplify and speed up the manufacturing of electronic components, the electronic packaging technology changes gradually, from the traditional dual in-line package (DIP) technology to the surface mounted technology (SMT). Therefore, inductance elements which can be made by surface mounted technology are to be developed.

FIG. 1 illustrates an exploded view of an existing inductance element 3. The inductance element 3 includes a coil 30, a core 31, a housing 32, and two terminal pieces 33. The terminal pieces 33 are adapted to meet the SMT technology, so that the inductance element 3 can be securely assembled to a circuit board (not shown) via the terminal pieces 33. Each of the terminal pieces 3 has an extended portion 330, and the extended portions 330 are respectively in contact with two output ends 301, 301*b* of the coil 30. In addition, in order to make the contact between the coil 30 and the terminal pieces 33 close, soldering spots may be provided to increase the contact area between the coil 30 and the terminal pieces 33.

However, as compared to a DIP inductance element, the existing inductance element 3 includes too many components. Thus, the manufacturing process of the existing inductance is more complicated and its material cost is higher. Furthermore, the addition of the terminal pieces 33 and the soldering spots causes the resistance and the copper loss of the inductance element 3 changed. In addition, after the inductance element 3 is assembled to the circuit board, a thermal stress between the housing 32 and the terminal pieces 33 due to temperature change would break the housing 32. Therefore, the complex structure of the existing inductance element 3 is not only hardly introduced to mass production, but also the labor cost is increased. Additionally, the reliability and the yield rate of the existing inductance are barely controlled well.

FIG. 2 illustrates an exploded view of another existing inductance element 2. The inductance element 2 shown in FIG. 2 is an improved version of the inductance element 3 of FIG. 1. In FIG. 2, the coil 20 is modified; specifically, the two terminal pieces 33 of the inductance element 3 in FIG. 1 are replaced by two electrical connecting portions 202*a*, 202*b* of the coil 20, so that the inductance element 2 is connected to a circuit board via the electrical connecting portions 202*a*, 202*b*.

However, in the manufacturing of the existing conductance element 2, the electrical connecting portions 202*a*, 202*b* have to be bent parallel with respect to the length direction of the coil 20 so as to meet the SMT packaging criteria. In addition, the bending angle should be controlled by machines; otherwise, the coils 20 may have different bending angles. Furthermore, since the electrical connecting portions 202*a*, 202*b* are parts of the coil 20 and are directly connected to the circuit board, the electrical connecting portions 202*a*, 202*b* are in contact with the circuit board by the proximate end section) of the electrical connecting portion 202*a*, 202*b*. The end section is too small to meet the structural strength for soldering. In order to increase the contact area between the circuit board and the inductance element 2 to meet the structural strength for soldering, the electrical connecting portions 202*a*, 202*b* are extended so as to increase the length of the proximate end section of each of the electrical connecting portions 202*a*, 202*b*. However, once copper wires are provided as the electrical connecting portions 202*a*, 202*b*, the resistance of the inductance element 2 will increase, and the usage of the tin solder will also increase, thus elevating the material costs. In addition, the electrical connecting portions 202*a*, 202*b* is located below the inductance element 2 and the operator's sightline is blocked by the housing of the inductance element 2; therefore, the operator cannot determine whether or not the solder between the inductance element 2 and the circuit board is properly formed through naked-eye investigation.

SUMMARY

In view of these, an improved inductance element is provided. The inductance element meets the SMT packaging criteria, thus simplifying the manufacturing procedures, reducing the costs, and improving the yield and product stability of the inductance element.

An embodiment of the inductance element comprises a housing, a core, and a coil. The core is assembled in the housing. The coil comprises a wire and two plate-shaped pins. The wire surrounds the core. The two plate-shaped pins are respectively assembled to two ends of the wire. The thickness of each of the plate-shaped pins is less than the diameter of the wire, and the two plate-shaped pins are exposed from the housing through two grooves of the housing, respectively.

In one embodiment, the two plate-shaped pins are oppositely extended from the wire along a direction not parallel to the length direction of the core, respectively.

In one embodiment, the two plate-shaped pins are oppositely extended from the wire along a direction substantially perpendicular to the length direction of the core, respectively.

In one embodiment, the inductance element further comprises an adhesive member disposed on the wire near two ends of the core so that the wire is adhered to the housing.

In one embodiment, the two plate-shaped pins are oppositely extended from the wire along a direction substantially parallel to the length direction of the core, respectively.

In one embodiment, the inductance element further comprises an adhesive member disposed between the wire and the housing, so that the wire is adhered to the housing.

In one embodiment, each of the plate-shaped pins is adhered to a surface of each of the grooves by an adhesive member.

In one embodiment, a thickness is defined between an outer wall of the housing and an inner wall of the housing, so that an adhering surface is formed on each of the two grooves and the adhesive members are respectively disposed on the adhering surfaces.

In one embodiment, the two grooves are diagonally defined on the periphery of the housing.

In one embodiment, the depth of each of the grooves is equal to or less than the thickness of each of the plate-shaped pins.

In one embodiment, the inductance element further comprises at least one adhesive member, wherein a thickness is defined between an outer wall of the housing and an inner wall of the housing, so that an adhering surface is formed on each of the two grooves, the adhesive member is disposed on the adhering surface, disposed on the wire near two ends of the core, or disposed on both the adhering surface and a portion of the wire near the two ends of the core, the two grooves are diagonally defined on the periphery of the housing, and wherein the depth of each of the grooves is equal to or less than the thickness of each of the plate-shaped pins.

Accordingly, based on the embodiments of the inductance element, the thickness of each of the plate-shaped pins is less than the diameter of the wire to meet the SMT packaging criteria, and the flat surface of the plate-shaped pins can be provided for soldering, such that the inductance element can be connected to a circuit board. In addition, because of the adhesive member disposed in the inductance element, the coil can be firmly positioned in the housing, so that the inductance element can be securely connected to the circuit board. As compared with the existing inductance element which has the terminal pieces and the soldering spots, the inductance element according to embodiments of the instant disclosure has a simple structure and can be manufactured in an easier manner, thereby promoting the stability and the yield of the products. Moreover, as compared with the existing inductance element which applies the electrical connecting portions as the connection part for soldering with a circuit board, the inductance element according embodiments of the instant disclosure has a flat surface so as to be soldered with a circuit board firmly. Therefore, in the embodiments of the instant disclosure, the length of the pins does not need to be increased for ensuring the soldering between the inductance element and the circuit board, thus reducing the material costs. Furthermore, in one embodiment of the inductance element, the plate-shaped pins are substantially the extensions of the two ends of the wire, and the plate-shaped pins are oppositely extended form the wire along a direction substantially perpendicular to the length direction of the core, therefore, the inductance element can meet the SMT packaging criteria without applying the bending procedure for the plate-shaped pins. In addition, since the plate-shaped pins are protruded and exposed from the housing, the manufacturing personnel can observe the soldering between the inductance element and the circuit board by naked eye, or the examination of the soldering between the inductance element and the circuit board can be introduced into automated production.

BRIEF DESCRIPTION OF THE DRAWINGS

The disclosure will become more fully understood from the detailed description given herein accompanying by the following figures, which are illustration only, and thus not limitative of the disclosure, wherein.

DETAILED DESCRIPTION

Figure 1:
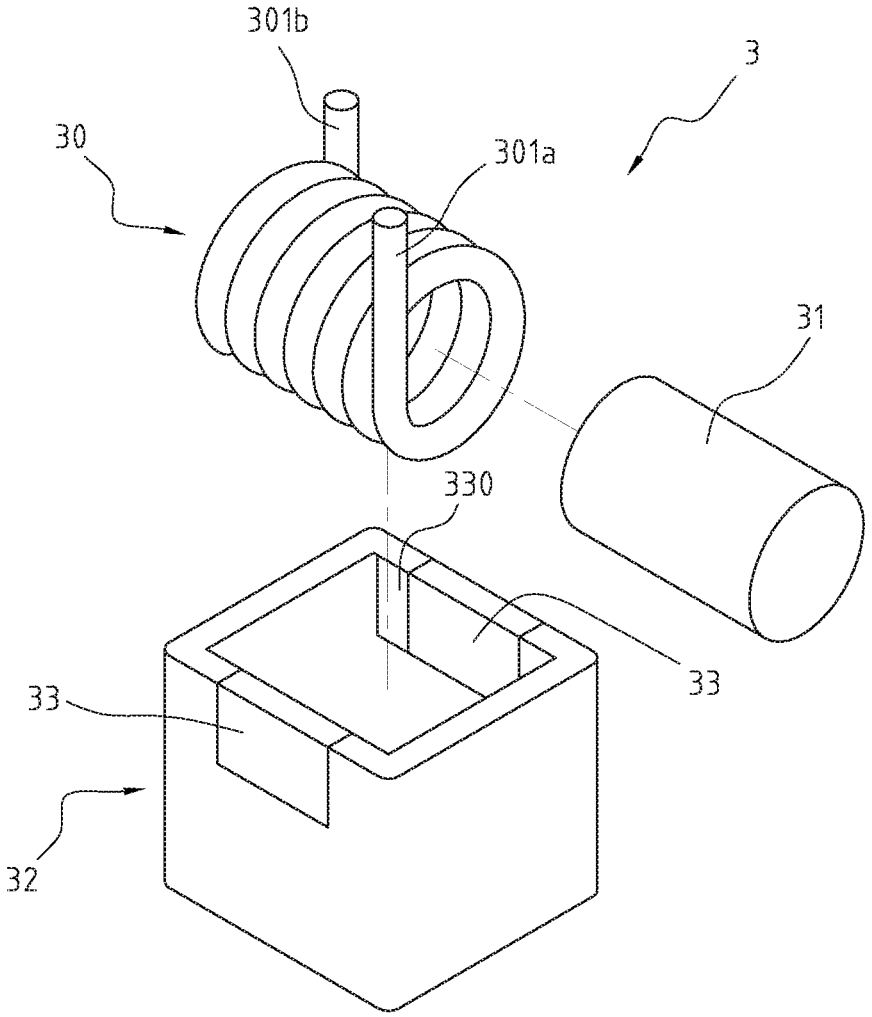
FIG. 1 (Prior Art)
FIG. 1 illustrates an exploded view of an existing inductance element.
Figure 2:
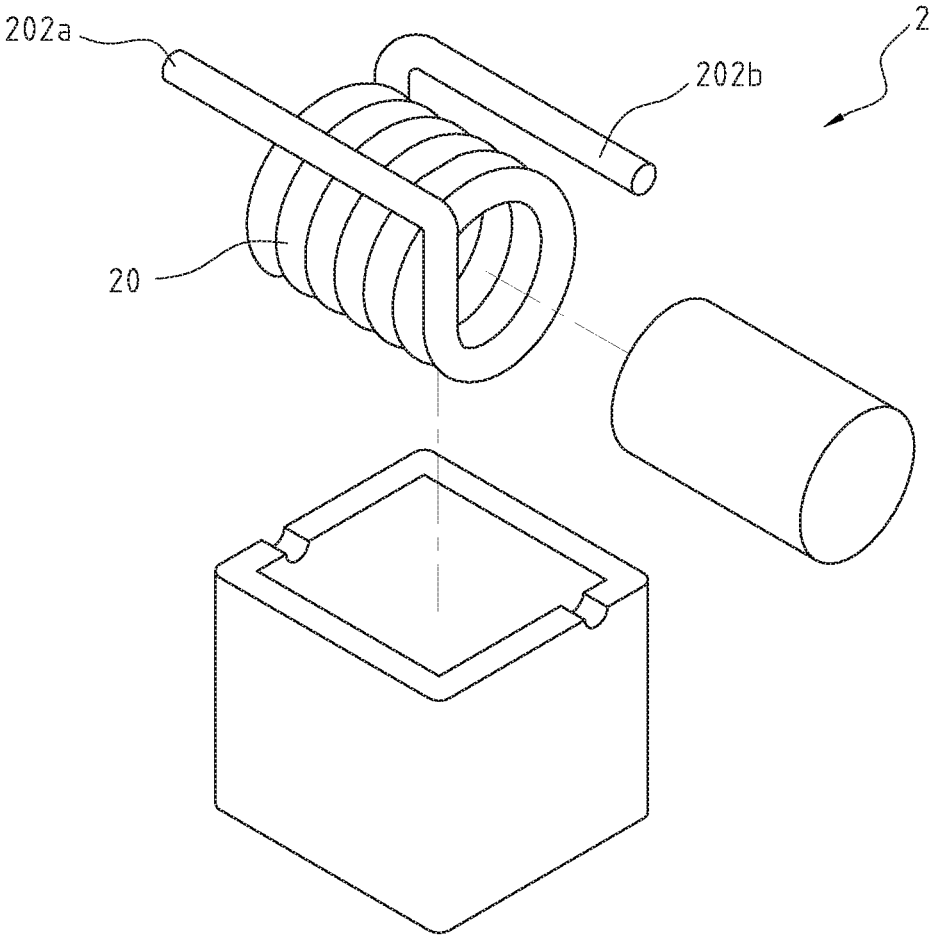
FIG. 2 (Prior Art)
FIG. 2 illustrates an exploded view of another existing inductance element.
Figure 3A:
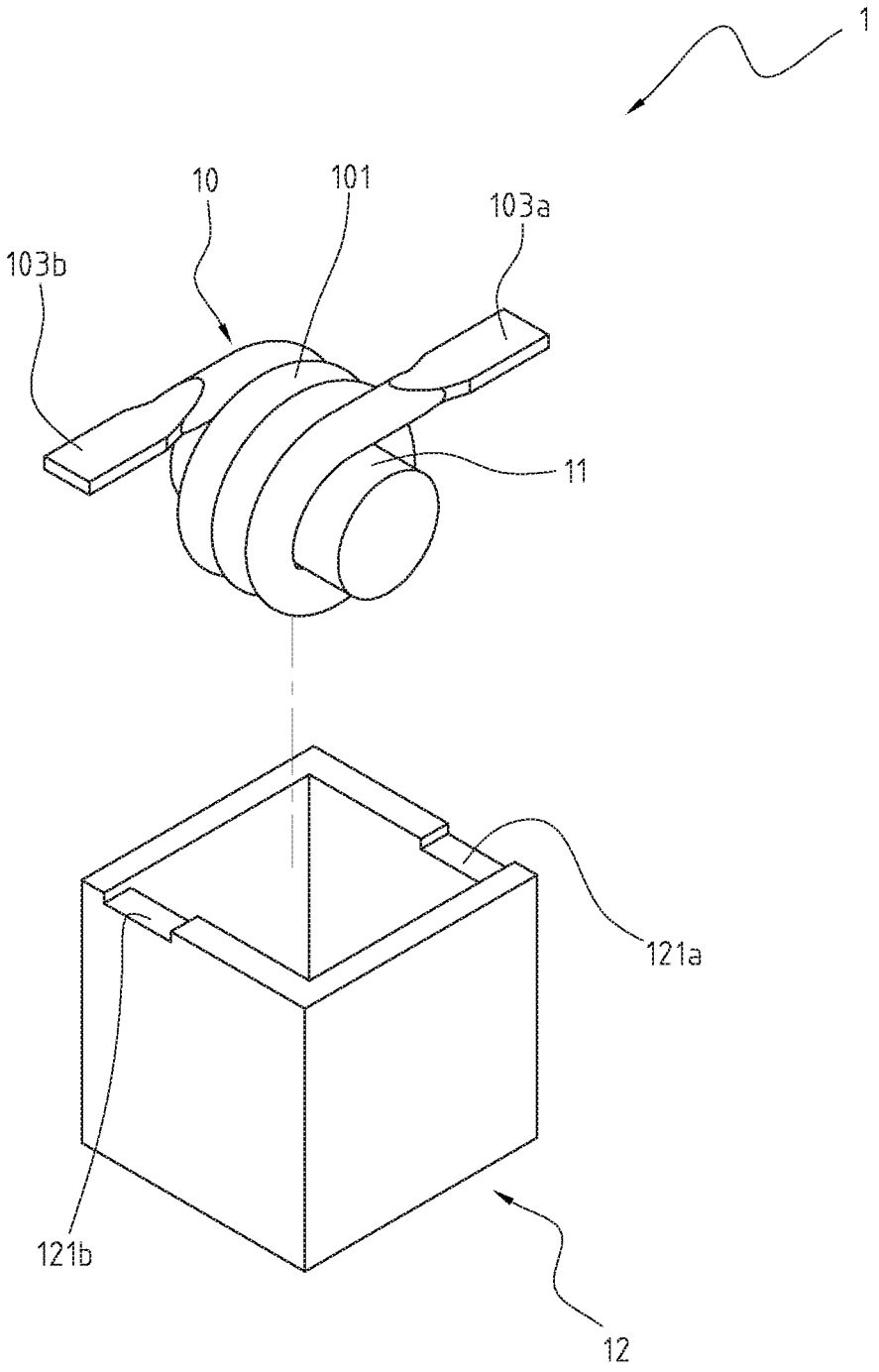
FIG. 3A illustrates an exploded view of an inductance element according to a first embodiment of the instant disclosure.

FIG. 3A illustrates an exploded view of an inductance element 1 according to a first embodiment of the instant disclosure. Please refer to FIG. 3A, in which the inductance element 1 comprises a coil 10, a core 11, and a housing 12. The core 11 is assembled in the housing 12. The coil 10 comprises a wire 101 and two plate-shaped pins 103*a*, 103*b*. The wire 101 surrounds the core 11. The two plate-shaped pins 103*a*, 103*b* are respectively at two ends of the wire 101. In this embodiment, the two plate-shaped pins may be assembled to the two ends of the wire 101, respectively. The thickness of each of the plate-shaped pins 103*a*, 103*b* is less than the diameter of the wire 101.

Figure 3B:
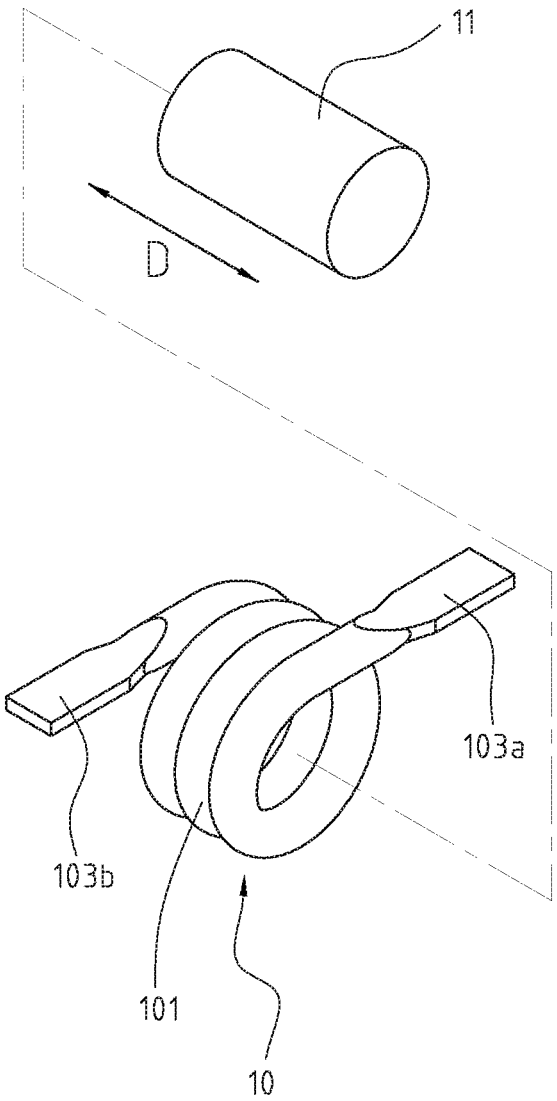
FIG. 3B illustrates a partial exploded view of the inductance element of the first embodiment.

FIG. 3B illustrates a partial exploded view of the inductance element 1 of the first embodiment. As shown in FIG. 3B, during the manufacturing of the coil 10, the wire 101 may be winded in an automatic manner, and the two ends of the wire 101 are preserved from being winded. The two plate-shaped pins 103*a*, 103*b* are substantially the extensions of the two ends of the wire 101, and the two plate-shaped pins 103*a*, 103*b* are oppositely extended from the wire 101 along a direction substantially perpendicular to the length direction D of the core 11. Therefore, after the wire 101 is winded, the plate-shaped pins 103*a*, 103*b* are aligned to their proper directions, i.e., the plate-shaped pins 103*a*, 103*b* are extended toward two ends of a direction substantially perpendicular to the length direction D of the core 11. Being different from the existing inductance element, the inductance element 1 according to embodiments of the instant disclosure can meet the SMT packaging criteria without the bending procedure for the ends of the wire 101.

Next, the two ends of the wire 101 are pressed so as to form the two plate-shaped pins 103*a*, 103*b* each of which may have an even surface, and the thickness of each of the plate-shaped pins 103*a*, 103*b* is less than the diameter of the wire 101. Accordingly, the manufacturing of the coil 10 is finished. The two plate-shaped pins 103*a*, 103*b*, each having a flat outline, are provided to be soldered on a circuit board (not shown) to meet the SMT packaging criteria. In addition, the two plate-shaped pins 103*a*, 103*b* may be provided to be electrically connected to an external circuit (not shown).

The core 11 is formed integrally as a whole. In this embodiment, the core 11 is a cylinder. In addition, in order to allow the inductance element 1 to be utilized for different products and different frequencies, the core 11 made be made of, but not limited to, copper, iron, nickel, etc.

Figure 3C:
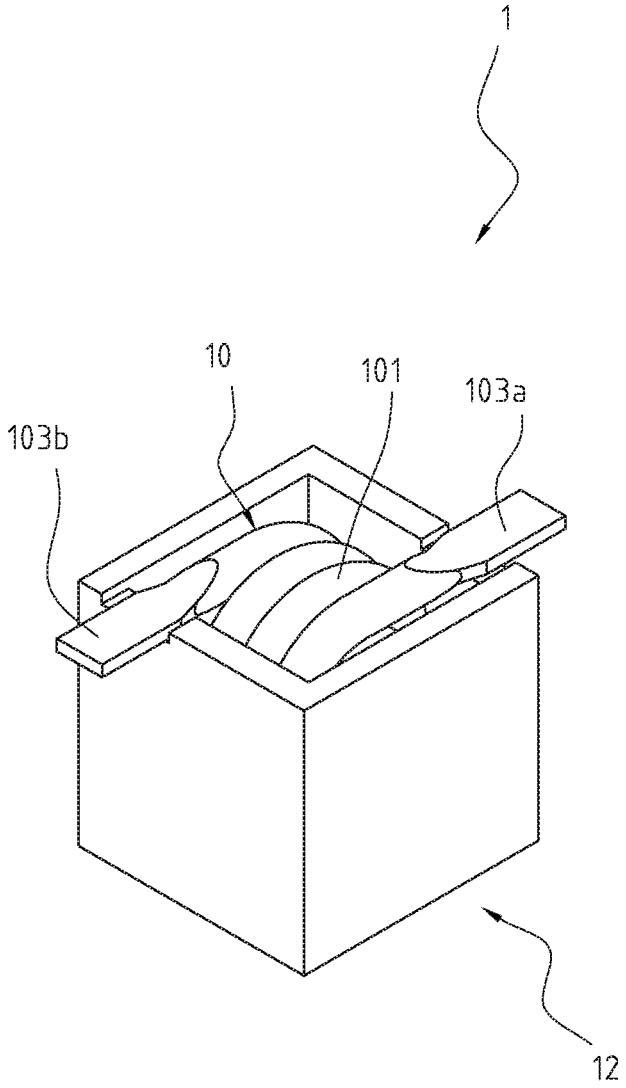
FIG. 3C illustrates a perspective view of the inductance element of the first embodiment.

FIG. 3C illustrates a perspective view of the inductance element 1 of the first embodiment. Please refer to FIG. 3A and FIG. 3C. In assembling the inductance element 1, firstly, as shown in FIG. 3A, the core 11 is disposed in the space within the coil 10 which is formed by winding the wire, and then, as shown in FIG. 3C, the coil 10 together with the core 11 are assembled in a receiving space defined in the housing 12 to form the inductance element 1.

As shown in FIG. 3, the housing 12 may be cuboid shaped, and the housing 12 may be made of magnetic materials. The housing 12 defines two grooves 121*a*, 121*b* whose positions correspond to the positions of the two plate-shaped pins 103*a*, 103*b*. In this embodiment, the two plate-shaped pins 103*a*, 103*b* are formed without bending the wire 101, the two grooves 121*a*, 121*b* are diagonally defined on the periphery of the housing 12, and the positions of the grooves 121*a*, 121*b* correspond to the positions of the plate-shaped pins 103*a*, 103*b*.

After the coil 10 and the core 11 are completely received in the housing 12, the two plate-shaped pins 103*a*, 103*b* are respectively in contact with the bottom surfaces of the two grooves 121*a*, 12*b* and protruded from the housing 12 (i.e. the thickness of the plate-shaped pins 103*a*, 103*b* is higher than the depth of the corresponding grooves 121*a*, 121*b*).

Figure 4:
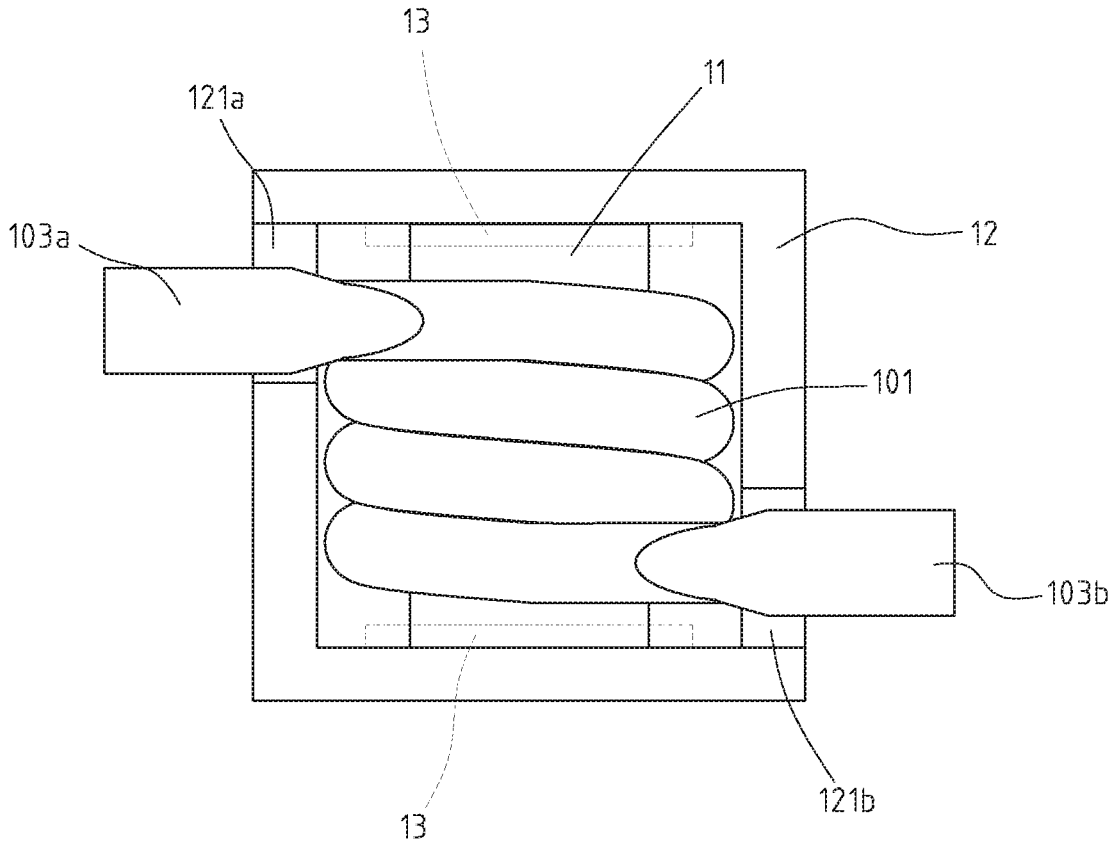
FIG. 4 illustrates a top plan view of the inductance element of the first embodiment.

FIG. 4 illustrates a top plan view of the inductance element 1 of the first embodiment. As shown, the plate-shaped pins 103*a*, 103*b* are respectively exposed out of the housing 12 through the grooves 121*a*, 121*b*.

Figure 5:
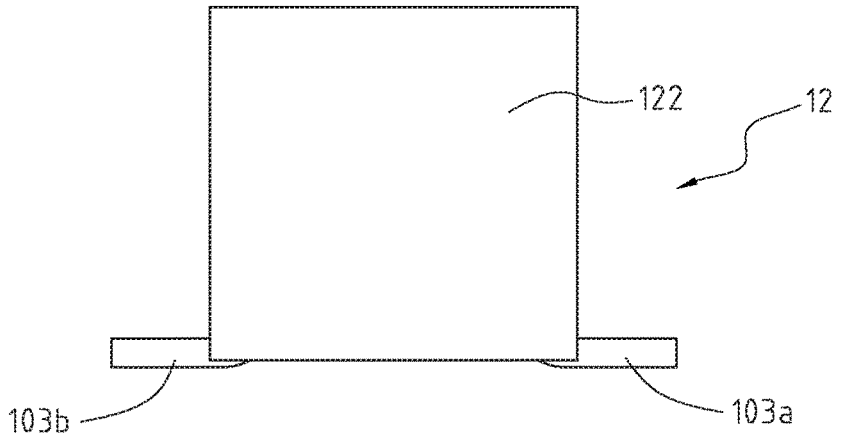
FIG. 5 illustrates a rear elevational view of the inductance element of the first embodiment.
Figure 6:
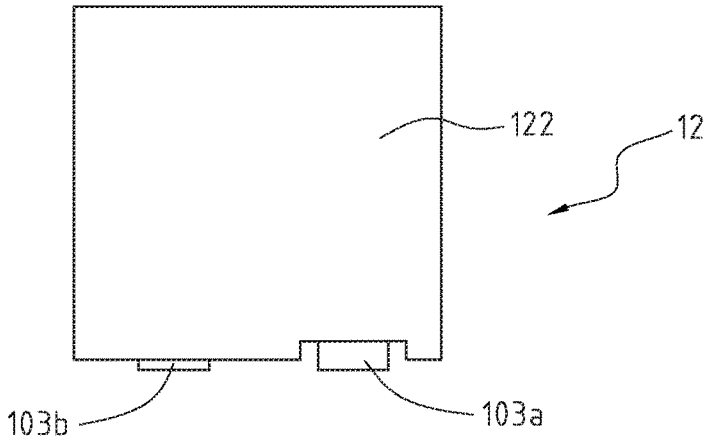
FIG. 6 illustrates a left side elevational view of the inductance element of the first embodiment.
Figure 7:
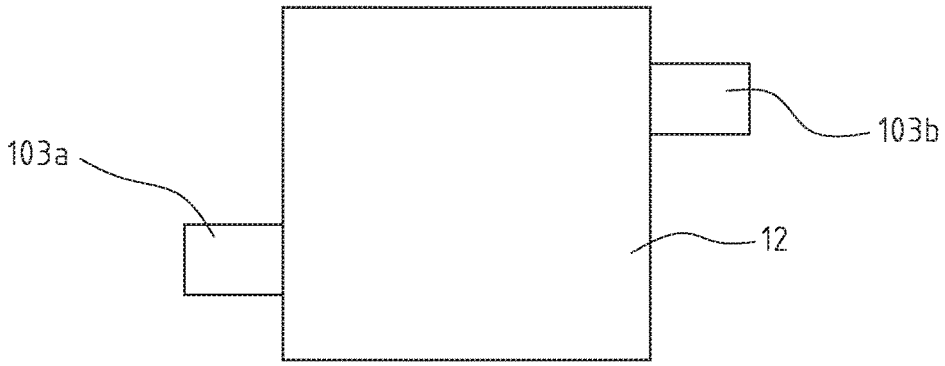
FIG. 7 illustrates a bottom plan view of the inductance element of the first embodiment.

FIGS. 5-7 respectively illustrate a rear elevational view, a left side elevational view, and a bottom plane view of the inductance element 1 of the first embodiment.

As shown in FIG. 5, the length direction of the plate-shaped pins 103*a*, 103*b* are perpendicular to the outer walls of the housing 12 where the grooves 121*a*, 121*b* are defined on. As shown in FIG. 6, the depth of each of the grooves 121*a*, 121*b* is less than the thickness of each of the plate-shaped pins 103*a*, 103*b*. Therefore, the plate-shaped pins 103*a*, 103*b* are protruded from the housing 12 along a direction parallel to the outer wall 122 of the housing 12 (i.e., parallel to the height direction of the housing 12 shown in FIG. 3C). In one embodiment, the depth of each of the grooves 121*a*, 12*b* may be equal to the thickness of each of the plate-shaped pins 103*a*, 103*b*, such that the surface of each of the plate-shaped pins 103*a*, 103*b* is aligned with the periphery of the housing 12. As shown in FIG. 7, the plate-shaped pins 103*a*, 103*b* are protruded from the housing 12 along the length direction of the plate-shaped pins 103*a*, 103*b*. After the coil 10 and the core 11 are completely received in the housing 12, a circuit board is disposed below the housing 12 and the circuit board faces the opening of the housing 12 (i.e., the opening of the receiving space). And then, the tin solders are applied to a proximate surface of each of the plate-shaped pins 103*a*, 103*b* where the proximate surfaces face the circuit board, so that the inductance element 1 is soldered on the circuit board. Accordingly, the inductance element 1 can be securely soldered on the circuit board, and the operator can examine the soldering between the inductance element 1 and the circuit board by naked-eye, or an automated production equipment can be implemented for examine the soldering.

Figure 8:
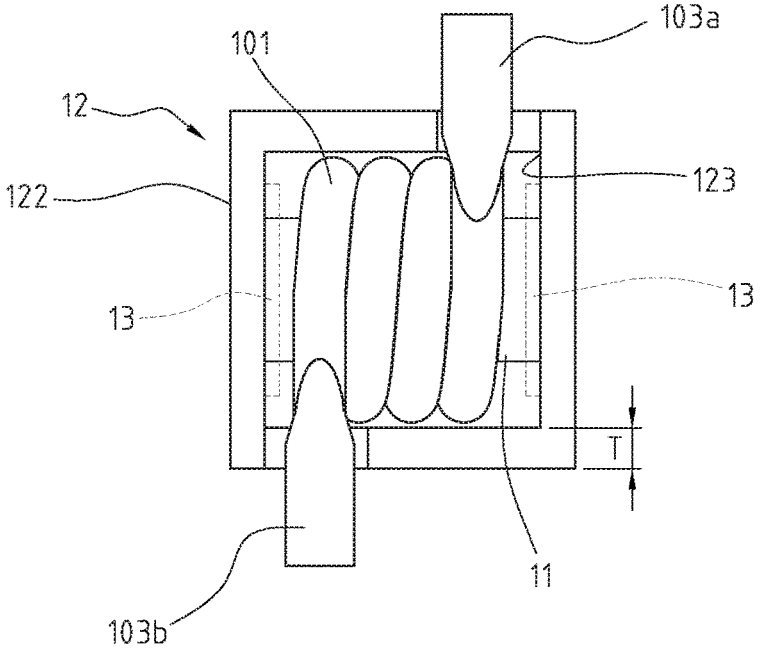
FIG. 8 illustrates a schematic view (1) of an embodiment of an adhesive member of the first embodiment of the inductance element.
Figure 9:
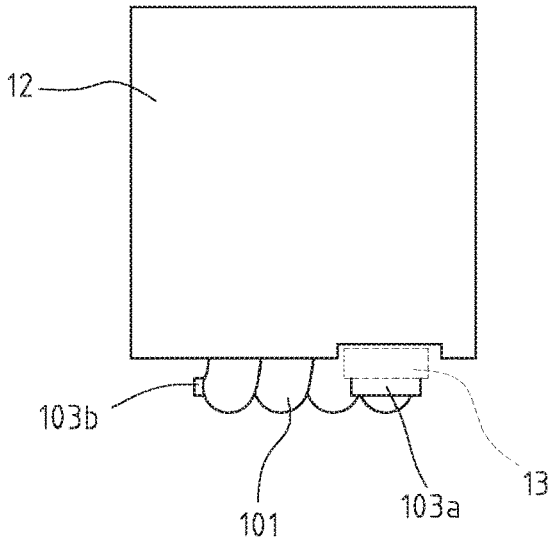
FIG. 9 illustrates a schematic view (2) of the embodiment of the adhesive member of the first embodiment of the inductance element.

In addition, in order to prevent the coil 10 detaching from the housing 12 due to shaking or impacting, the inductance element 1 further comprises an adhesive member 13. FIGS. 8 and 9 illustrate schematic views of an embodiment of an adhesive member 13 of the first embodiment of the inductance element 1. The adhesive member 13 is disposed on the wire 101 near two ends of the core 11, i.e., the adhesive member 13 may be disposed on the wire 101 near two ends of core 11 to fill the space between the wire 101 and an inner wall 123 of the housing 12 (this embodiment is not shown), or the two ends of the core 11 are directly adhered to the inner wall 123 of the housing 12 via adhesive members 13 (as shown in FIG. 8). Accordingly, the wire 101 of the coil 10 can be adhered to the housing 12 and does not detach from the housing 12 easily.

Please refer to FIGS. 8 and 9, in order to allow the plate-shaped pins 103*a*, 103*b* to be firmly disposed in the grooves 121*a*, 121*b*, a thickness T is defined between the inner wall 123 and the outer wall 122, so that an adhering surface is formed on each of the grooves 121*a*, 121*b* (i.e., the adhering surface of each of the grooves 121*a*, 121*b* is the bottom surface of each of the grooves 121*a*, 121*b*). Before the coil 10 is received in the housing 12, the adhesive member 13 is disposed on the surface of each of the plate-shaped pins 103*a*, 103*b* facing the housing 12, i.e., the adhesive members 13 are disposed between the plate-shaped pins 103*a*, 103*b* and the grooves 121*a*, 121*b*. The housing 12 defines the thickness T to form the adhering surfaces for disposing the adhesive members 13, the adhesive surfaces of the grooves 121*a*, 121*b* and the plate-shaped pins 103*a*, 103*b* can be adhered with each other by the adhesive members 13. In other words, each of the plate-shaped pins 103*a*, 103*b* is adhered to the adhering surface of the corresponding groove 121*a*, 121*b* by the adhesive member 13.

The adhesive member 13 may be, but not limited to, solders, tapes, or resin glues. As long as the wire 101 can be secured in the housing 12 and the plate-shaped pins 103*a*, 103*b* can be secured to the grooves 121*a*, 121*b* by a material, such material meets the criteria of the adhesive member 13.

Accordingly, based on the first embodiment of the inductance element 1, the thickness of each of the plate-shaped pins 103*a*, 103*b* is less than the diameter of the wire 101 to meet the SMT packaging criteria, and the flat surface of the plate-shaped pins 103*a*, 103*b* can be provided for soldering, such that the inductance element 1 can be connected to a circuit board. Additionally, because of the adhesive member 13 disposed in the inductance element 1, the coil 10 can be firmly positioned in the housing 12, so that the inductance element 1 can be securely connected to the circuit board. As compared with the existing inductance element which has the terminal pieces and the soldering spots, the inductance element 1 according to embodiments of the instant disclosure has a simple structure and can be manufactured in an easier manner, thereby promoting the stability and the yield of the products. Moreover, as compared with the existing inductance element which applies the electrical connecting portions as the connection part for soldering with a circuit board, the inductance element 1 has a flat surface so as to be soldered with a circuit board firmly. Therefore, in the embodiments of the instant disclosure, the length of the plate-shaped pins 103*a*, 103*b* does not need to be increased for ensuring the soldering between the inductance element 1 and the circuit board, thus reducing the material costs. Furthermore, in the first embodiment of the inductance element 1, the plate-shaped pins 103*a*, 103*b* are substantially the extensions of the two ends of the wire 101, and the plate-shaped pins 103*a*, 103*b* are oppositely extended form the wire 101 along a direction substantially perpendicular to the length direction D of the core 11, therefore, the inductance element 1 can meet the SMT packaging criteria without applying the bending procedure for the plate-shaped pins 103*a*, 103*b*. In addition, since the plate-shaped pins

103*a*, 103*b* are protruded and exposed from the housing 12, the manufacturing personnel can observe the soldering between the inductance element 1 and the circuit board by naked eye, or the examination of the soldering between the inductance element 1 and the circuit board can be introduced into automated production.

Figure 10:
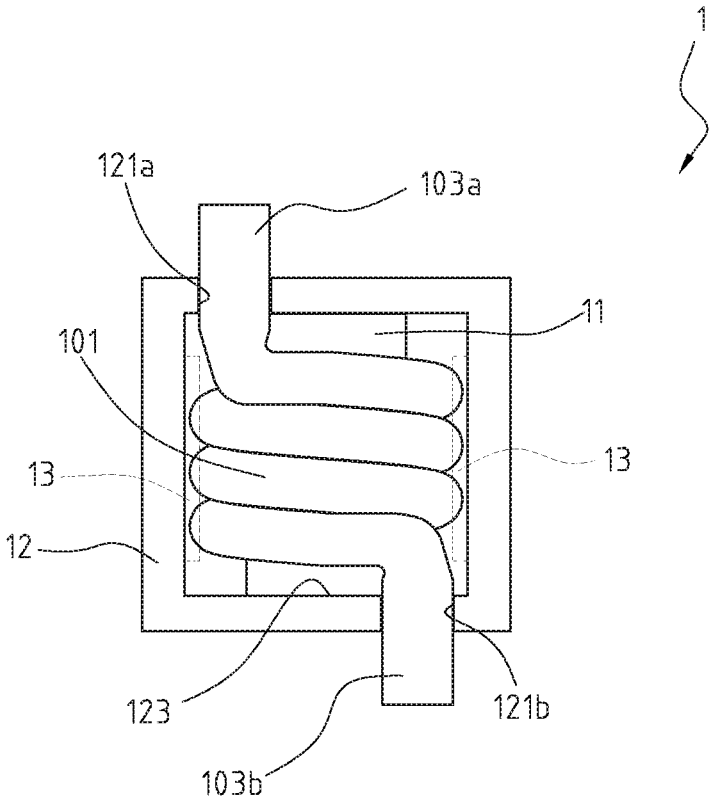
FIG. 10 is a top plan view of an inductance element according to a second embodiment of the instant disclosure.

FIG. 10 is a top plan view of an inductance element 1 according to a second embodiment of the instant disclosure. Please refer to FIGS. 3A to 3C and FIG. 10. Alike the first embodiment, the inductance element 1 comprises a coil 10, a core 11, and a housing 12. In the second embodiment, two plate-shaped pins 103*a*, 103*b* of the coil 10 are oppositely extended from the wire 101 along a direction substantially parallel to the length direction D of the core 11, respectively. In order to position the coil 10 in the housing 12, adhesive members 13 are not only disposed between the plate-shaped pins 103*a*, 103*b* and the bottom surface of the grooves 121*a*, 121*b*, but also disposed at two sides of the coil 10 in which the two sides of the coil 10 are perpendicular to the length direction D of the core 11. Accordingly, the coil 10 can be positioned on the inner wall 123 of the housing 12.

Accordingly, based on the second embodiment of the inductance element 1, the thickness of each of the plate-shaped pins 103*a*, 103*b* is less than the diameter of the wire 101 to meet the SMT packaging criteria, and the flat surface of the plate-shaped pins 103*a*, 103*b* can be provided for soldering, such that the inductance element 1 can be connected to a circuit board. In addition, because the adhesive member 13 disposed in the inductance element 1, the coil 10 can be firmly positioned in the housing 12, so that the inductance element 1 can be securely connected to the circuit board. As compared with the existing inductance element which has the terminal pieces and the soldering spots, the inductance element 1 according to embodiments of the instant disclosure has a simple structure and can be manufactured in an easier manner, thereby promoting the stability and the yield of the products. Moreover, as compared with the existing inductance element which applies the electrical connecting portions as the connection part for soldering with a circuit board, the inductance element 1 according to embodiments of the instant disclosure has a flat surface so as to be soldered with a circuit board firmly. Therefore, in the embodiments of the instant disclosure, the length of the plate-shaped pins 103*a*, 103*b* does not need to be increased for ensuring the soldering between the inductance element 1 and the circuit board, thus reducing the material costs. In addition, since the plate-shaped pins 103*a*, 103*b* are protruded and exposed from the housing 12, the manufacturing personnel can observe the soldering between the inductance element 1 and the circuit board by naked eye, or the examination of the soldering between the inductance element 1 and the circuit board can be introduced into automated production.

While the disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An inductance element comprising:

a housing defining two grooves and comprising an inner wall and an outer wall, and the two grooves are diagonally defined on the periphery of the housing;

a core disposed in the housing; and a coil disposed in the housing and comprising a wire and two plate-shaped pins, wherein the wire surrounds the core, wherein the thickness of each of the plate-shaped pins is less than the diameter of the wire, the two plate-shaped pins are respectively exposed from the housing through the two grooves, wherein the two plate-shaped pins are extended in opposite directions along two parallel paths respectively passing through the two grooves diagonally defined on the periphery of the housing and the two plate-shaped pins are perpendicular to the inner wall and the outer wall, and wherein the two plate-shaped pins are extended straight from an end of the wire, and there is no bend from the end of the wires to the plate-shaped pins.

2. The inductance element according to claim 1, wherein the depth of each of the two grooves is equal to or less than the thickness of each of the two plate-shaped pins.

3. The inductance element according to claim 1, wherein:

the core extends along a longitudinal axis from a first end to a second end; and the two grooves are displaced from each other along a direction of the longitudinal axis.

4. The inductance element according to claim 3, wherein:

the housing has a top, a bottom, and sidewalls extending between the top and the bottom; and the sidewalls define the two grooves are disposed through the sidewalls.

5. The inductance element according to claim 3, wherein a first of the plate-shaped pins is exposed from the housing by extending straight from a first end of the wire and through a first of the two grooves and a second of the plate-shaped pins is exposed from the housing by extending straight from a second end of the wire and through a second of the two grooves.

6. The inductance element according to claim 1, wherein the two entire plate-shaped pins are oppositely extended from the wire along a direction not parallel to the length direction of the core, respectively.

7. The inductance element according to claim 6, wherein the two plate-shaped pins are oppositely extended from the wire along a direction substantially perpendicular to the length direction of the core, respectively.

8. The inductance element according to claim 6, further comprising an adhesive member disposed on the wire near two ends of the core so that the wire is adhered to the housing.

9. The inductance element according to claim 6, further comprising at least one adhesive member, wherein a thickness is defined between the outer wall of the housing and the inner wall of the housing, so that an adhering surface is formed on each of the two grooves, the adhesive member is disposed on the adhering surface, disposed on the wire near two ends of the core, or disposed on both the adhering surface and a portion of the wire near the two ends of the core, and wherein the depth of each of the two grooves is equal to or less than the thickness of each of the two plate-shaped pins.

10. The inductance element according to claim 6, wherein each of the two plate-shaped pins is adhered to a surface of each of the grooves by an adhesive member.

11. The inductance element according to claim 10, wherein a thickness is defined between the outer wall of the housing and the inner wall of the housing, so that an adhering surface is formed on each of the two grooves and the adhesive members are respectively disposed on the adhering surfaces.

12. The inductance element according to claim 1, wherein the two plate-shaped pins are oppositely extended from the wire along a direction substantially parallel to the length direction of the core, respectively.

13. The inductance element according to claim 12, further comprising an adhesive member disposed between the wire and the housing so that the wire is adhered to the housing.

14. The inductance element according to claim 12, wherein each of the two plate-shaped pins is adhered to a surface of each of the grooves by an adhesive member.

15. The inductance element according to claim 14, wherein a thickness is defined between the outer wall of the housing and the inner wall of the housing, so that an adhering surface is formed on each of the two grooves and the adhesive members are respectively disposed on the adhering surfaces.

* * * * *